US010934651B2

(12) United States Patent
Bagatelli et al.

(10) Patent No.: US 10,934,651 B2
(45) Date of Patent: Mar. 2, 2021

(54) LAUNDRY WASHING MACHINE COMPRISING AN IMPELLER

(71) Applicant: Electrolux do Brasil S.A., Curitiba (BR)

(72) Inventors: Ricardo Bagatelli, Curitiba (BR); Cidmar Justos, Curitiba (BR); Marcelo Piekarski, Curitiba (BR); Luiz Carlos Pazinato, Curitiba (BR); Fabiano Costi, Curitiba (BR); Leonardo Jose Gembarowski, Curitiba (BR); Eduardo Orthmann, Curitiba (BR); Eduardo De Menezes Lino Modesto, Curitiba (BR); Claudio Roberto Gonçalves, Curitiba (BR)

(73) Assignee: Electrolux do Brasil S.A.

( * ) Notice: Subject to any disclaimer, the term of this patent is extended or adjusted under 35 U.S.C. 154(b) by 247 days.

(21) Appl. No.: 15/959,866

(22) Filed: Apr. 23, 2018

(65) Prior Publication Data

US 2018/0313013 A1 Nov. 1, 2018

(30) Foreign Application Priority Data

Apr. 27, 2017 (BR) ..... 10 2017 0089410

(51) Int. Cl.

| | |
|---|---|
| ***D06F 17/00*** | (2006.01) |
| ***D06F 17/10*** | (2006.01) |
| *D06F 39/08* | (2006.01) |
| *D06F 23/04* | (2006.01) |
| *D06F 39/10* | (2006.01) |

(52) U.S. Cl.
CPC ..... *D06F 17/10* (2013.01); *D06F 23/04* (2013.01); *D06F 39/083* (2013.01); *D06F 39/10* (2013.01)

(58) Field of Classification Search
CPC ..... D06F 17/10; D06F 39/10; D06F 23/04; D06F 39/083
See application file for complete search history.

(56) References Cited

U.S. PATENT DOCUMENTS

2011/0030425 A1* 2/2011 Kim ..... D06F 17/10 68/132
2014/0109627 A1* 4/2014 Lee ..... D06F 17/10 68/133

(Continued)

FOREIGN PATENT DOCUMENTS

JP 2012055546 A * 3/2012 ..... D06F 17/10
KR 20040078233 A 9/2004

(Continued)

*Primary Examiner* — Joseph L. Perrin
*Assistant Examiner* — Irina Graf
(74) *Attorney, Agent, or Firm* — RatnerPrestia

(57) ABSTRACT

A laundry washing machine having a washing basked and an impeller for conditioning the flow of the washing liquid during the operation of the laundry washing machine. The laundry washing machine has a washing basket, a feed lid and a mechanical impeller. The impeller has at least one intake opening and at least one outlet opening, the outlet openings being peripherally placed on a circumferential edge of the impeller. The washing basket has a housing recess defined by an upper plane and a lower plane; and the impeller is mounted in the housing recess, so that the outlet openings are placed above the top plane of the recess.

20 Claims, 6 Drawing Sheets

(56) References Cited

U.S. PATENT DOCUMENTS

| | | | | |
|---|---|---|---|---|
| 2014/0230496 | A1* | 8/2014 | Lee | D06F 17/04 68/133 |
| 2015/0033803 | A1* | 2/2015 | Carr | D06F 13/00 68/133 |
| 2017/0298550 | A1* | 10/2017 | Nishiura | D06F 23/04 |

FOREIGN PATENT DOCUMENTS

| | | | | |
|---|---|---|---|---|
| KR | 20070047554 | A | 5/2007 | |
| WO | 2016138683 | A1 | 9/2016 | |
| WO | 2016158164 | A1 | 10/2016 | |
| WO | WO-2017061837 | A1 * | 4/2017 | D06F 39/083 |

* cited by examiner

LAUNDRY WASHING MACHINE COMPRISING AN IMPELLER

This application claims the benefit of and priority to Brazil Patent Application No. 10 2017 0089410, filed Apr. 27, 2017, which is incorporated by reference herein.

FIELD OF THE INVENTION

This invention relates to an impeller-comprising laundry washing machine capable of preparing optimum flow of the washing liquid during the operation of the laundry washing machine.

BACKGROUND OF THE INVENTION

Laundry washing machines are household, commercial or industrial equipment widely employed to assist in the task of cleaning garments or fabrics in general, due to their practicality and time-saving features provided to the user.

Laundry washing machines are usually provided with a main cabinet, a washing basket and an input dispenser, also comprising in some models a mechanical agitator and a lint filter.

It is known that laundry washing machines of the type comprising a mechanical impeller for effecting movement of the washing liquid and textile articles within the washing basket have an increase in washing efficiency due to the movement caused by the mechanical impeller. The mechanical impeller is commonly concentrically mounted to the washing basket and performs a rotational, generally reciprocating movement for the purpose of moving the washed textile article and the washing liquid, enhancing the passage of the washing liquid through the textile articles and the release of grime impregnated into the fibers of the fabrics, thereby increasing washing efficiency.

Laundry washing machines fitted with a mechanical impeller may be provided with a top feed (comprising an upper lid giving access to a washing basket), or front feed (comprising a front door giving access to a washing basket). The washing basket is in the area where the textile articles and washing liquid are located.

Washing liquid is understood to be a mixture of water and any type of soap, bleach, fabric softener or laundry compounds, blended at any ratio. Furthermore, textile articles are understood to mean any type of clothing, towels, sheets or other articles composed of textile material which one wishes to wash with the aid of a laundry washing machine.

Also, laundry washing machines commonly comprise filters which have the function of retaining lint, dirt and any other elements suspended in the wash liquid which may be retained in the washed articles.

It is also known that the mechanical impellers comprise openings in their wall to allow the washing liquid to enter the area immediately behind the impeller, causing said liquid to be pushed back into the washing basket by means of blades placed in its inferior area, using the centrifugal force concept.

Laundry washing machines equipped with impellers comprise the advantage of having a simpler and less costly construction compared to laundry washing machines equipped with mechanical agitators (projections extending along the washing basket, provided with radial projections which carry out moving the washing liquid and the textile articles). However, they have the disadvantage of being less efficient in providing movement of the washing liquid and textile articles inside the washing basket, in view of the fact that the area of contact with said liquid is significantly smaller.

Accordingly, there are several Prior Art washing impellers which seek to provide an optimized solution in the agitation of washing liquid and textile articles, by means of different constructive configurations of said impeller.

WO 2016/138683 relates to an impeller for mounting inside a washing basket of a laundry washing machine, having a concave perforated upper surface and forming projections, in order to drive the washing liquid according to the rotation of the impeller. Such a solution, however, does not provide for a configuration which can act in conjunction with the geometry of the projections to carry out the washing liquid pulse, with efficiency being limited.

WO 2016/158164 relates to an impeller to be mounted within a washing basket of a laundry washing machine, having a concave perforated upper surface that forms projections, in order to drive the washing liquid according to direction in which the impeller rotates and furthermore, a plurality of openings along the entire surface of said projections to their peripheral end to permit radial flow of the washing liquid placed in the area posterior to said impeller. Such a solution, however, provides a dilution of the outlet pressure of the washing liquid located in the area posterior to the impeller, since as the liquid is expelled in the radial direction due to the rotational movement of the impeller, said liquid is partially expelled through all openings of said projections, the increased efficiency being minimal to said impeller.

Documents KR1020030013052 and KR1020050104418 present an idealized lint-retention filter for mounting in the peripheral area of a washing basket for use in laundry washing machines which do not comprise a mechanical agitator provided with a filtration element mounted therein. Such solutions, however, are restricted only to the filtration step, bringing no benefit to the movement performed by the liquid within the washing basket.

Therefore, there is no laundry washing machine provided with a mechanical impeller in the Prior Art which provides high washing efficiency. Furthermore, none of the Prior Art solutions makes use of a filtration element which also optimizes the flow of movement of the washing liquid inside the washing basket.

OBJECTIVES AND DESCRIPTION OF THE INVENTION

Therefore, it is an object of this invention to provide a laundry washing machine equipped with a mechanical impeller capable of providing high washing efficiency in comparison with Prior Art solutions.

One or more objects of this invention are achieved by means of a laundry washing machine provided with a washing basket, a feed lid and a mechanical impeller, wherein the impeller comprises at least one intake opening and at least one outlet opening, outlet openings being peripherally placed on a circumferential edge of the impeller, the washing basket comprises a housing recess defined by a top plane and a bottom plane, and the impeller is mounted in the housing recess, so that the outlet openings are placed above the upper plane of the recess or aligned with the upper plane of the recess, thereby directing the outlet flow from the bottom of the washing basket and optimizing the movement of the washing liquid into the washing basket.

One or more objects of this invention are achieved by means of a laundry washing machine wherein said outlet openings are peripherally placed on the edges of the impeller, distributing the outlet of the washing liquid in all directions around the impeller.

One or more objects of this invention are achieved by means of a laundry washing machine wherein the basket comprises peripheral deflectors placed on the edges of the washing basket, responsible for directing the newly expelled liquid through the impeller outlet openings back into the inner area of the washing basket.

One or more objects of this invention are achieved by means of a laundry washing machine in which the upper surface of the impeller comprises projections for agitation, responsible for directing the motion of the washing liquid inside the washing basket and increasing the turbulence inside the washing basket and, consequently, the washing efficiency of the textile articles.

One or more objects of this invention are achieved by means of a laundry washing machine in which the lower surface of the impeller comprises radial vanes.

One or more objects of this invention are achieved by means of a laundry washing machine wherein the impeller comprises a cover layer to an axis of rotation, the cover comprising geometry coincident with the projections for agitation of the impeller.

One or more objects of this invention are achieved by means of a laundry washing machine in which a peripheral deflector is associated with a housing of a filtration element, the body being provided with geometry continuous to the geometry of the peripheral deflector.

One or more objects of this invention are achieved by means of a laundry washing machine wherein the impeller assembly in the housing recess of the washing basket defines a peripheral opening for the passage of an outlet flow generating a radial outlet flow of the washing liquid comprised of the flow obtained from the outlet openings, optimizing the movement of the washing liquid inside the basket.

One or more objects of this invention are achieved by means of a laundry washing machine in which the housing recess comprises an annular geometry, in which the blades and the impeller edges are in particular partially housed and rotatable within the annular geometry of the housing recess, below the upper plane of the recess.

One or more objects of this invention are achieved by means of a laundry washing machine in which the base of the washing basket comprises a peripheral arched portion defined between the plane at the height of the edge and an upper plane of the housing recess.

Thus, the impeller of this invention comprises a geometry defined by a disk having openings to admit the washing liquid which are outlet openings for the washing liquid, the intake openings being located on the upper surface of the impeller, and the outlet openings located on the peripheral surface of the impeller. Furthermore, the impeller comprises a plurality of radial vanes on its lower surface, so as to direct the washing liquid towards the impeller edges, optimizing the flow of liquid to be expelled by said outlet openings.

In particular, the outlet openings are located close to the bottom plane of the washing basket, above an upper plane of the housing recess and below an upper edge plane of the base, the impeller being partially housed within a housing in the bottom of the basket.

The laundry washing machine of this invention further comprises a plurality of peripheral deflectors located on the edges of the washing basket, in order to redirect the flow of washing liquid back into the basket forming a washing vortex, thus optimizing the washing efficiency for the textile articles placed inside the laundry washing machine.

At least one of said peripheral deflectors may comprise filtration elements therein, so that at least a portion of the washing liquid directed to the deflector is passed through a filtration element for the retention of lint and other soils inconvenient to the washing process of clothes.

In addition, the placement of the impeller assembly in a recess of the washing basket defines a peripheral gap between the impeller and said recess, which is subjected to a flow pressure of the washing liquid driven by the vanes placed on the lower surface of the impeller. In this way, an outlet flow is formed from this vane, composing a total outlet flow from the wash flow with the flow leaving the radial openings of the impeller. Thus, in addition to a larger outflow (and consequently greater movement of the washing liquid inside the washing basket compared to Prior Art solutions), an outlet flow composition of different types is also obtained, optimizing the washing process of the textile articles packed inside the laundry washing machine.

BRIEF DESCRIPTION OF THE DRAWINGS

The objectives, technical effects and advantages of this invention will be apparent to those skilled in the art from the following detailed description with reference to the accompanying Figures, which illustrate exemplary but not limiting embodiments of the invention.

DESCRIPTION OF EMBODIMENTS OF THE INVENTION

Figure 1:
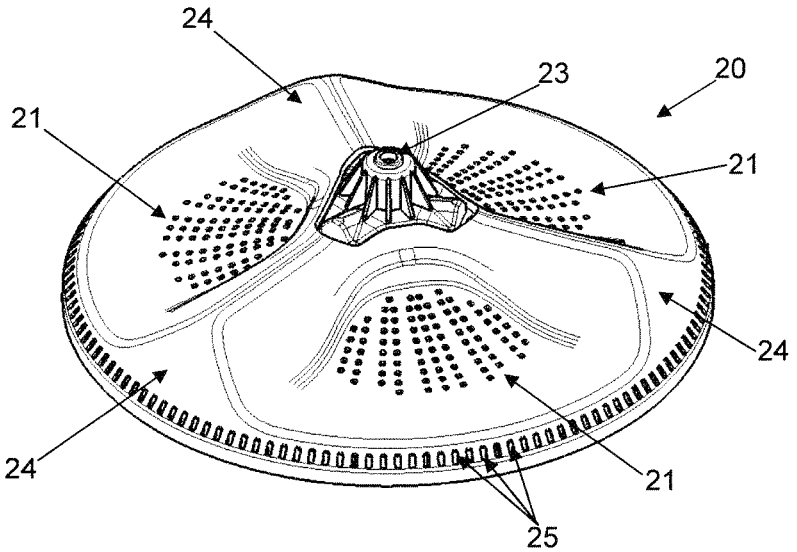
FIG. 1 shows an embodiment of the laundry washing machine impeller 20 of this invention in a view in perspective of its top surface, where one can observe the presence of intake openings 21, a rotation axis 23, projections for agitation 24, and a plurality of outlet radial openings 25.

Initially, it should be pointed out that the laundry washing machine, object of this invention, will be described below according to particular but not limiting embodiments, since its embodiment may be realized in different shapes and variations and according to the desired application by the technician in the art.

The laundry washing machine of this invention is of the type that is loaded at the upper region and is provided with a cabinet and at least one opening placed at its top, where the opening gives access to a washing basket comprising a mechanical impeller concentrically mounted to the washing basket.

In particular, the laundry washing machine 1 of this invention is provided with a washing basket 50, a feed lid 2 and a mechanical impeller 20. For the purposes of this invention, what is meant as a feed lid 2 is any door or cover intended to cover the opening area of the basket 50 through which the laundry washing machine 1 is loaded with the textile articles to be washed, which may be, for example, a type loaded through the top or through the front.

The impeller 20 of this invention comprises at least one intake opening 21, being placed on the upper surface of the impeller 20. In a preferred embodiment, the impeller comprises a plurality of openings 21 distributed in groups separated by projections for agitation, as shown in FIGS. 1 to 6. In particular, the pluralities of openings 21 are located more towards the center of the impeller 20, so that the inlet to the lower area of the impeller 20 occurs from the area of lower pressure, the washing liquid being directed to the edges of the impeller 20, or the area of greatest pressure during its rotation.

A plurality of outlet openings 25 are located adjacent to the higher-pressure area located at the edges of the impeller, which allow the washing liquid to flow from the higher-pressure area back into the washing basket 50.

The washing basket 50 comprises a base 30 provided with a plane at the height of the edge 34 and a housing recess 31 for mounting the impeller 20. The base further comprises a peripheral arched portion 35 which intersects the plane at the height of the edge 34 and an upper plane 32 of the housing recess 31.

The housing recess 31 is defined by a lower plane 32 and an upper plane 33, such that it enables the formation of a gap 74 between the housing recess 31 and the impeller 20 mounted therein. The housing 31 being able to be provided with annular geometry. Said vane 74 has the function of enabling the formation of an outflow stream 73 of the washing liquid from the rear area of the impeller towards the washing area within the basket 50.

When the impeller 20 is mounted in the housing recess 31, the outlet openings 25 are located between the plane at the height of the edge 34 and the upper plane 33 of the recess 21, so that the flow expelled by said outlets will be composed of the outlet flow 73 and directed to the washing basket with sufficient energy to generate vortices within the washing basket 50 and thereby optimize the washing process.

In particular, as shown in FIGS. 3 and 5 to 11, in one embodiment of this invention, the laundry washing machine impeller 20 is partially housed in a recess 31 placed in the base 30 of a basket 50 of a laundry washing machine, so that a gap 74 is formed peripherally between the impeller 20 and the recess 31, and that the outlet openings 25 are located close to the bottom of the washing basket 50.

In one embodiment of this invention, the upper surface of the impeller 20 comprises agitator projections 24 defined in a geometry capable of creating undulations and turbulences in the washing liquid contained within the washing basket 50, and again preparing the washing liquid in the washing areas fitted with intake openings. The impeller may further comprise a cover 26 mounted in its central area, with geometry harmonic to the geometry of the projections for agitation 24, so as to optimize the movement of the washing liquid during the operation of the laundry washing machine of this invention.

Figure 2:
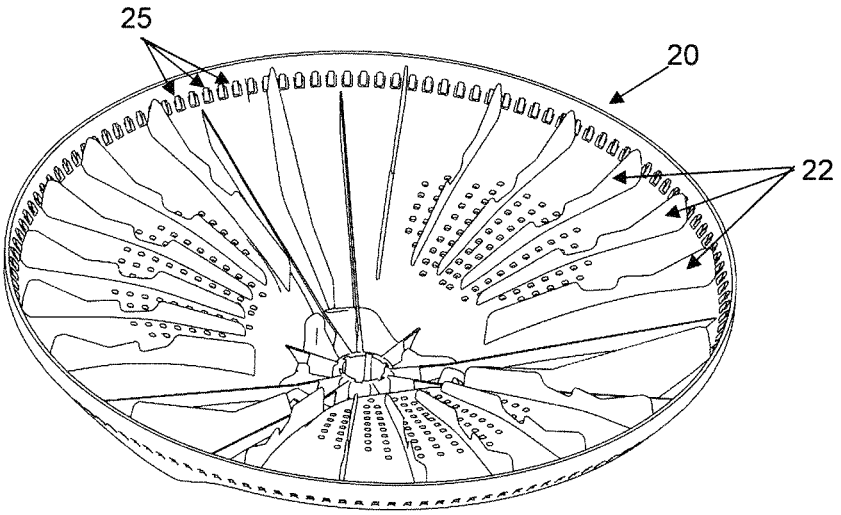
FIG. 2 shows an embodiment of the laundry washing machine impeller 20 of this invention in a view in perspective of its top surface, showing the radial vanes 22 and a plurality of radial outlet openings 25.
Figure 3:
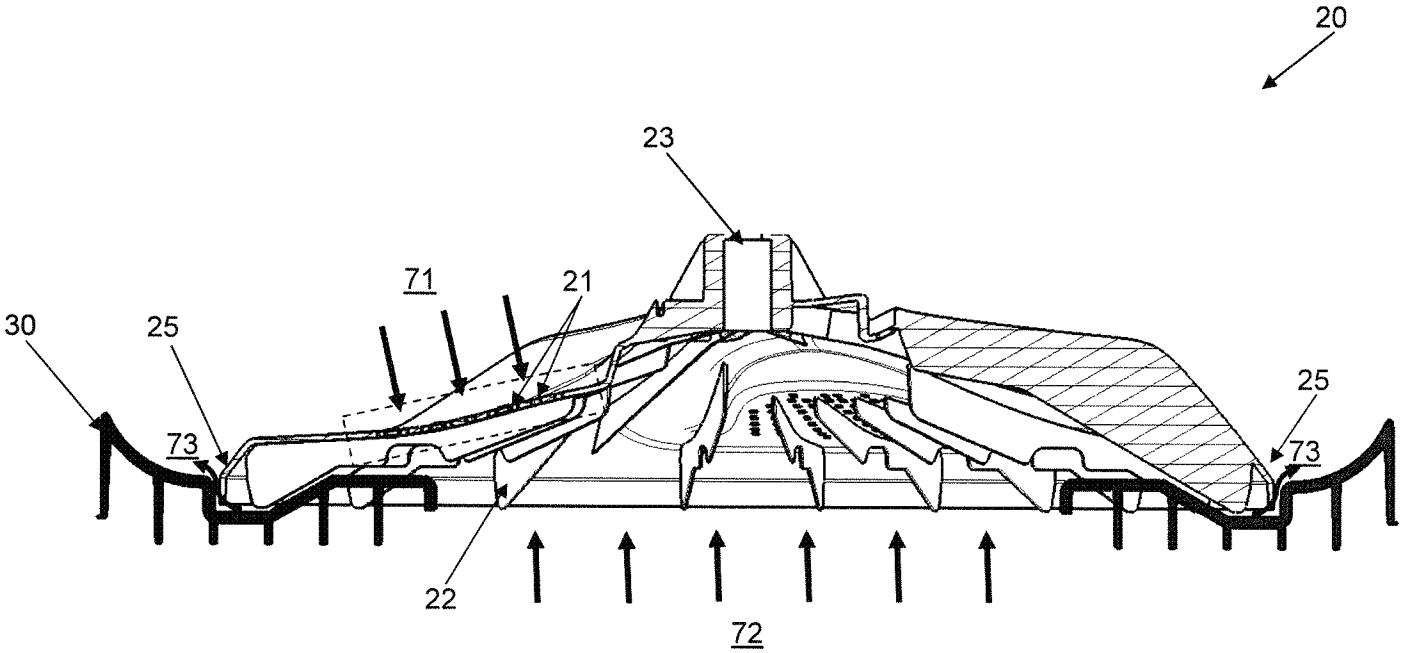
FIG. 3 shows a cross-sectional view of one embodiment of the impeller of the laundry washing machine 20 of this invention, illustrating its assembly in a recess 31 in the base of the washing basket 30 and the flow behavior of the washing liquid therein, an intake flow 71 and an absorption flow 72 being expelled through the composition between flows from the outlet opening 25 and outlet flow 73.
Figure 4:
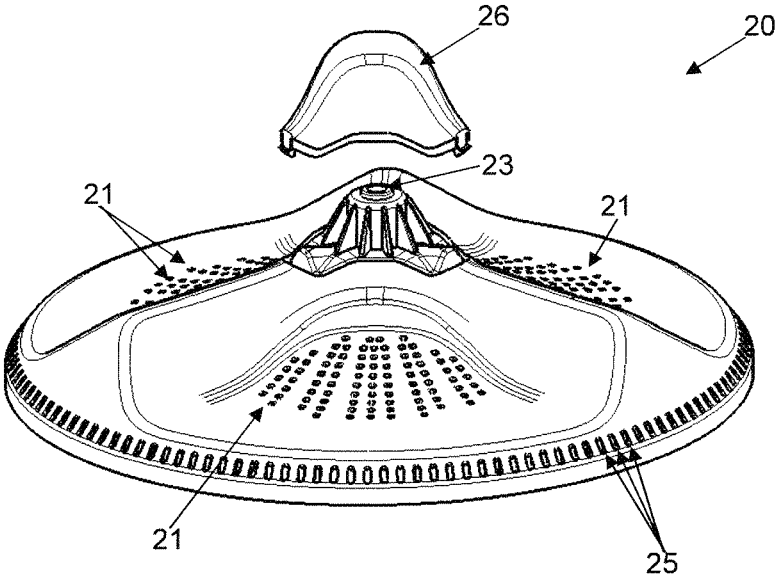
FIG. 4 shows an exploded view of an embodiment of the laundry washing machine impeller 20 of this invention, in an embodiment in which a cover 26 is employed to cover the axis of rotation.

In one embodiment of the invention, as shown in FIGS. 2 and 3, the lower surface of the impeller 20 comprises a plurality of radial vanes 22, spaced angularly from one another and extending from the center to the periphery of the impeller 20. Such projections allow the entrance of the washing liquid collected by the intake openings 21 and condition it to pass through the outlet openings 25, imposing energy on the liquid. Furthermore, said radial vanes 22 condition the washing liquid to pass through the gap 74, forming an outflow 73, the vanes 22 being partially housed and rotatable in the housing recess 31, to define the gap 74.

Figure 5:
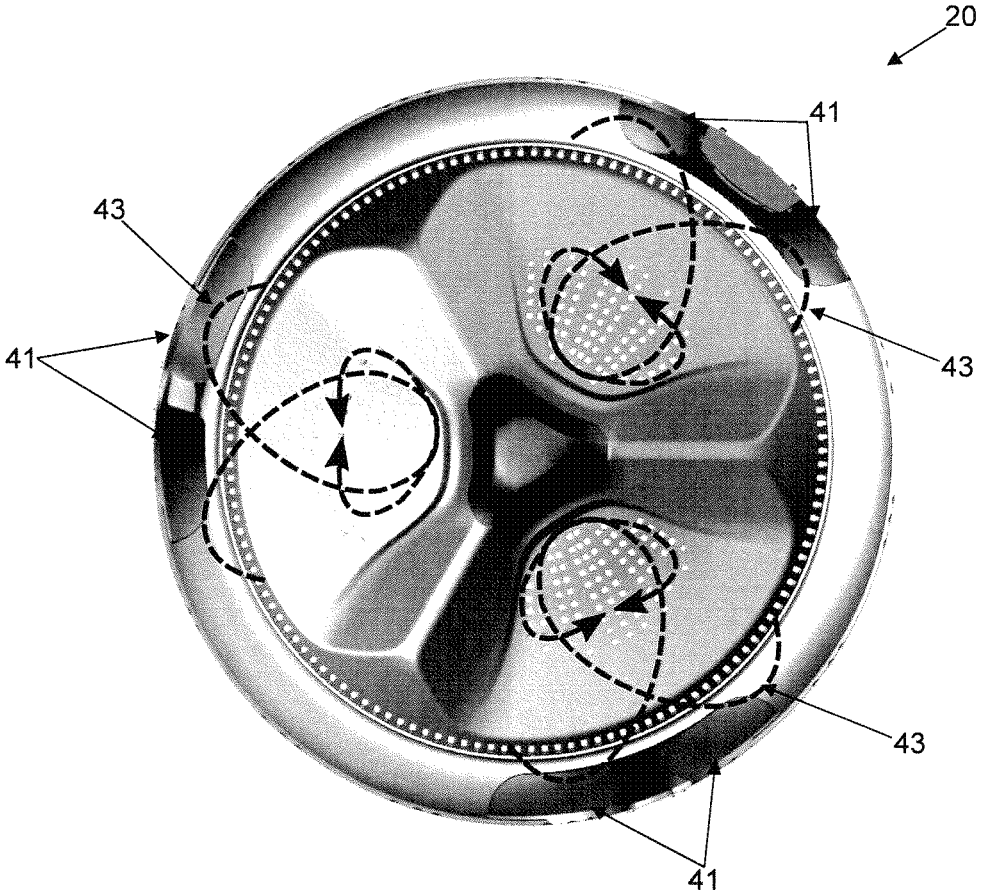
FIG. 5 shows a top view of the washing basket of the laundry washing machine of this invention representing the placement between the impeller 20, the deflectors 41 and 42 and the direction of the internal flow 73 formed by directing the washing liquid into the basket.
Figure 6:
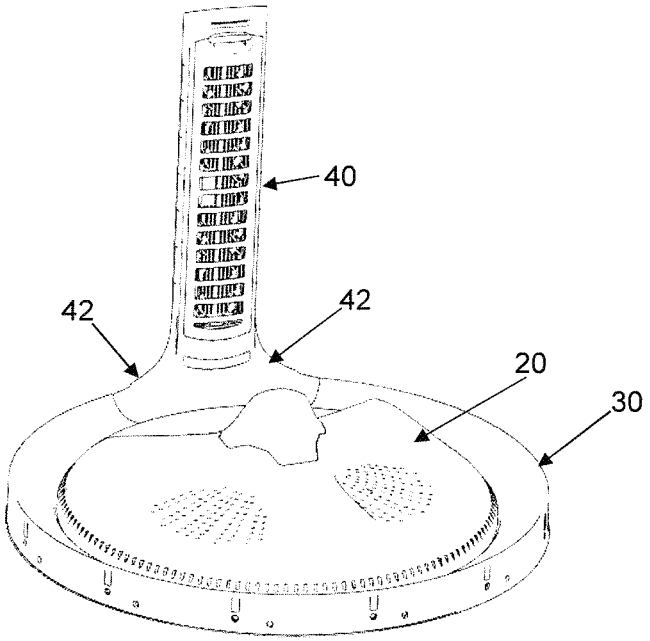
FIG. 6 shows an embodiment of this invention comprising an assembly formed by the base of the basket 30, the impeller 20 and the deflector 42 associated with a filtration element 40.
Figure 10:
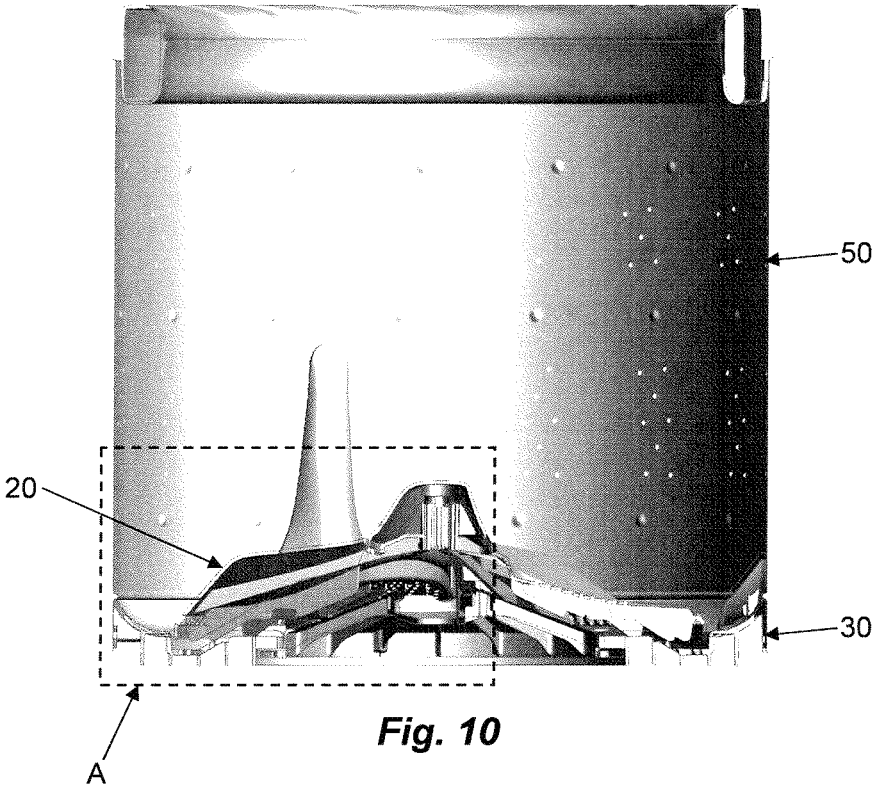
FIG. 10 shows a cross-sectional view of a washing basket 50 as shown in FIG. 7.
Figure 11:
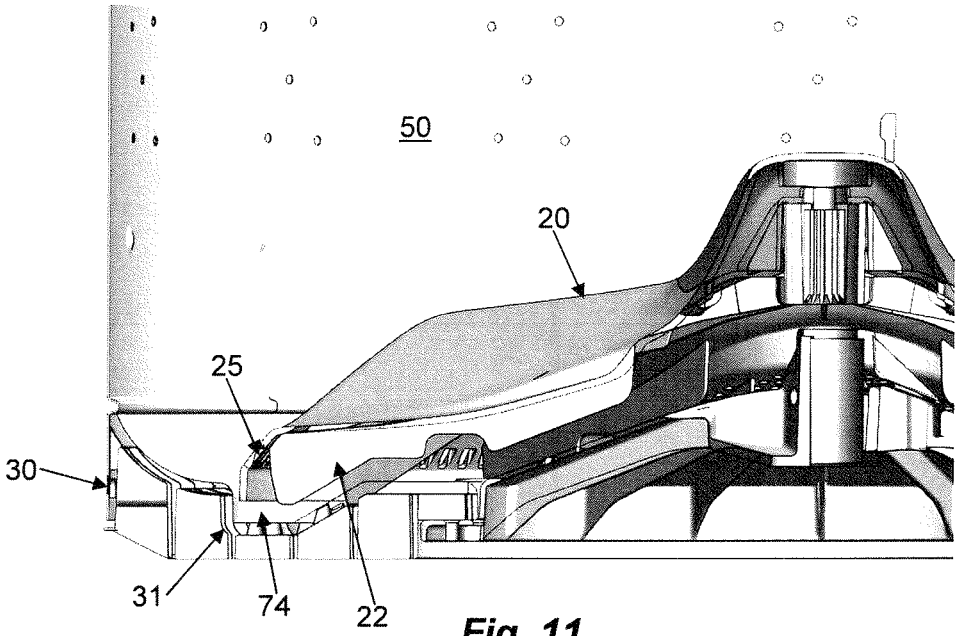
FIG. 11 shows a view of detail A shown in FIG. 10.

In a preferred embodiment of this invention, as can be seen in FIGS. 5, 6 and 10, the washing basket 50 comprises peripheral deflectors 41 and 42 located on its edges. For peripheral deflectors, geometry pieces are provided to condition the flow of the washing liquid so as to generate an internal flow 43 so as to optimize movement performed by the washing liquid into the basket, resulting in improvements in wash efficiency, for example defined by an association of arched surfaces integrated with each other. Still, as can be seen in FIG. 11, the peripheral edge of the impeller 20 and the end of its vanes 22 are partially placed below the upper plane 33 and are therefore housed and rotatable within the recess 31. Furthermore, the arched portion 35 of the base 30, by being aligned with the outlet openings 25, also assist in directing the flow of the washing liquid.

Figure 7:
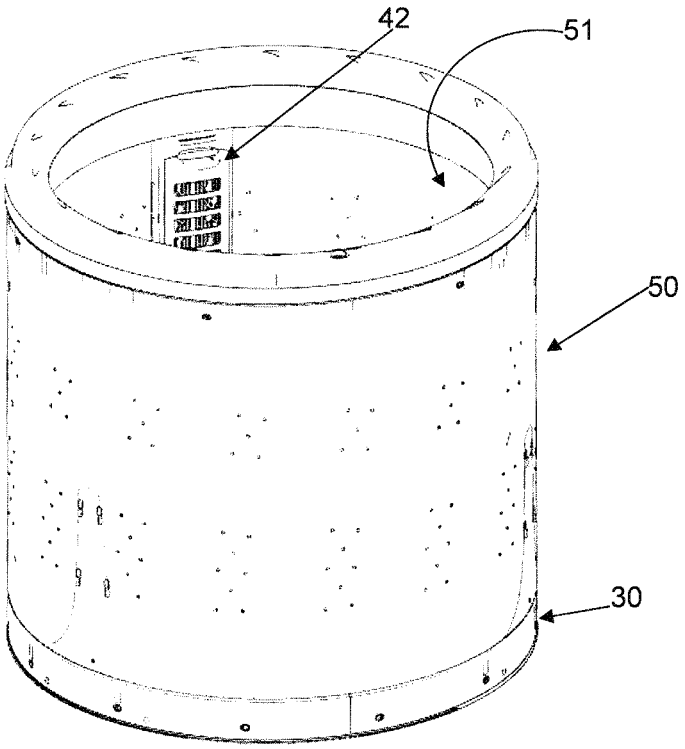
FIG. 7 shows the assembly represented by FIG. 6 mounted inside 51 of a washing basket 50.
Figure 8:
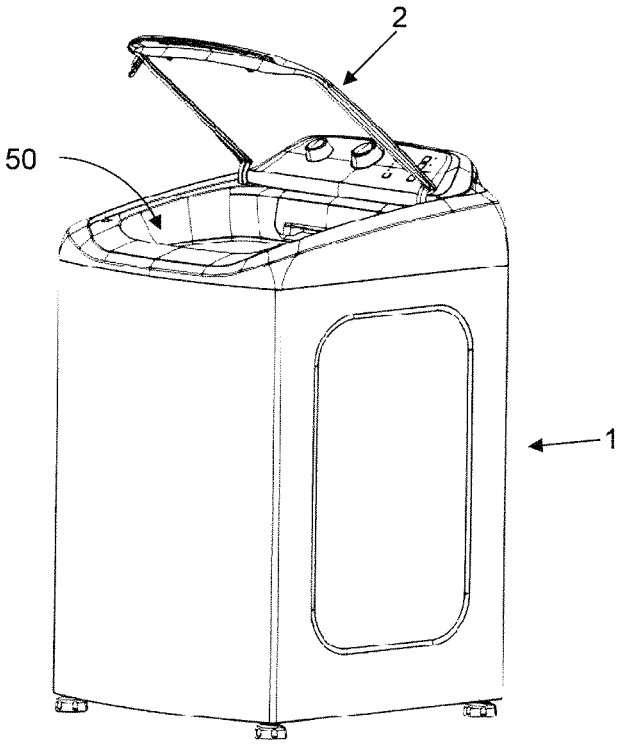
FIG. 8 shows a laundry washing machine 1 according to an embodiment of this invention, wherein said laundry washing machine is provided with an assembly as shown in FIGS. 6 and 7.
Figure 9:
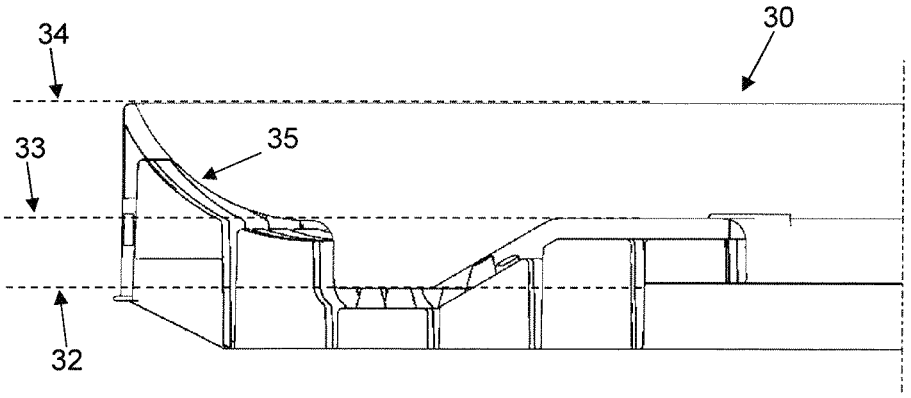
FIG. 9 shows a detail view of the recess area 31 of the basket base 30, in accordance with one embodiment of this invention, wherein a plane at the height of the edge 34, an upper plane 33 and a lower plane 32 are shown.

In one embodiment of this invention, as shown in FIGS. 6, 7 and 10, at least one of the peripheral deflectors is a peripheral deflector 42 associated with a housing 40 of a filtration element. More precisely, the body 40 comprises in its interior a filtration element for retaining lint and other soils contained in the washing liquid and undesirable to the laundry process of textile articles.

The body of the filtration element housing 40 comprises a geometry such that its side walls are provided with an arched surface in order to maintain the expected effect for the peripheral deflector 42.

Notwithstanding the description of the particular embodiments above, this invention may be embodied differently and may exhibit modifications in its form of implementation, so that the scope of protection of the invention is limited only by the content of the appended Claims, including all possible equivalent variations.

The invention claimed is:

1. A laundry washing machine comprising:

a washing basket comprising a base extending along an upper plane from a central portion of the washing basket towards a peripheral portion of the washing basket, the base having a circumferential housing recess formed by the base descending from the upper plane to a lower plane, extending along the lower plane, and then ascending from the lower plane to the upper plane;

a feed lid; and a mechanical impeller mounted in the washing basket and configured to rotate about a rotational axis, the mechanical impeller comprising at least one intake opening configured to intake water into the mechanical impeller and at least one outlet opening configured to output water from the mechanical impeller, the at least one outlet opening peripherally located on a circumferential edge of the mechanical impeller, with the mechanical impeller mounted so that the circumferential edge is within the housing recess and the at least one outlet opening is placed above the upper plane of the housing recess, wherein the upper plane and the lower plane are oriented perpendicular to the rotational axis of the mechanical impeller.

2. The laundry washing machine according to claim 1, wherein the washing basket comprises a peripheral edge located at a lower end of a peripheral wall of the washing basket, the peripheral edge being located in an edge plane that is oriented perpendicular to the rotational axis of the mechanical impeller at a location above the upper plane, and the one or more outlet openings are between the edge plane and the upper plane of the housing recess.

3. The laundry washing machine according to claim 1, wherein the washing basket comprises peripheral deflectors.

4. The laundry washing machine according to claim 3, wherein at least one peripheral deflector is associated with a housing of a filtration element, the housing of the filtration element having a surface geometry that is continuous to an adjacent surface geometry of an associated peripheral deflector.

5. The laundry washing machine according to claim 1, wherein an upper surface of the mechanical impeller comprises agitator projections.

6. The laundry washing machine according to claim 5, wherein the mechanical impeller comprises a cover at a rotational axis of the mechanical impeller.

7. The laundry washing machine according to claim 1, wherein a lower surface of the mechanical impeller comprises radial vanes.

8. The laundry washing machine according to claim 1, wherein a gap is defined between the mechanical impeller and the housing recess, the gap being configured for passage of an output flow.

9. The laundry washing machine according to claim 1, wherein the housing recess comprises an annular geometry.

10. The laundry washing machine according to claim 9, wherein a lower surface of the mechanical impeller comprises radial vanes, and the radial vanes are partially housed and rotational within the annular geometry of the housing recess.

11. The laundry washing machine according to claim 1, wherein the mechanical impeller is partially housed and rotational within an annular geometry of the housing recess.

12. The laundry washing machine according to claim 1, wherein the base of the washing basket extends to a peripheral edge at a lower end of a peripheral wall of the washing basket, and comprises an arched peripheral portion defined between the peripheral edge and the upper plane, wherein the peripheral edge is located in an edge plane that is oriented perpendicular to the rotational axis of the mechanical impeller at a location above the upper plane.

13. A laundry washing machine comprising:

a washing basket having a first end and a second end, the first end being open for receiving laundry therethrough, and the second end being closed and having a base extending along an upper plane from a central portion of the washing basket towards a peripheral portion of the washing basket, the base having a circumferential housing recess formed by the base descending from the upper plane to a lower plane, extending along the lower plane, and then ascending from the lower plane to the upper plane;

a feed lid selectively closing the first end of the washing basket;

a mechanical impeller provided in the washing basket at the second end of the washing basket and configured to rotate about a rotational axis, the mechanical impeller comprising a surface extending to a circumferential edge of the mechanical impeller located at least partially within the housing recess, and having at least one intake opening configured to intake water into the mechanical impeller and at least one outlet opening configured to output water from the mechanical impeller, the at least one outlet opening being peripherally located on the circumferential edge, with the outlet openings located above the upper plane of the housing recess;

wherein the upper plane and the lower plane are oriented perpendicular to the rotational axis of the mechanical impeller.

14. The laundry washing machine according to claim 13, wherein the washing basket comprises a peripheral edge located at a lower end of a peripheral wall of the washing basket, the peripheral edge being located in an edge plane that is oriented perpendicular to the rotational axis of the mechanical impeller at a location above the upper plane, and the one or more outlet openings there are positioned with their respective upper edges at a height between the edge plane and the upper plane of the housing recess.

15. The laundry washing machine of claim 13, wherein the housing recess comprises an annular geometry and the mechanical impeller is partially housed and rotational within the housing recess.

16. The laundry washing machine according to claim 15, wherein a lower surface of the mechanical impeller facing the second end of the washing basket comprises radial vanes extending towards the second end of the washing basket, the radial vanes being at least partially located within the housing recess.

17. The laundry washing machine according to claim 13, wherein a lower surface of the mechanical impeller facing the second end of the washing basket comprises vanes extending towards the second end of the washing basket.

18. The laundry washing machine according to claim 13, wherein the washing basket comprises one or more peripheral deflectors, and at least one of the one or more peripheral deflectors is associated with a filtration element having a body with a surface geometry that is continuous to an adjacent surface geometry of the one or more peripheral deflectors.

19. The laundry washing machine according to claim 13, wherein the mechanical impeller and the housing recess have a gap therebetween for passage of an output flow.

20. The laundry washing machine according to claim 13, wherein the washing basket comprises an arched peripheral portion extending from an outer perimeter of the housing recess at the upper plane of the housing recess towards the first end of the washing basket.

* * * * *